US008863856B2

(12) United States Patent
Eckholm et al.

(10) Patent No.: US 8,863,856 B2
(45) **Date of Patent: *Oct. 21, 2014**

(54) METHODS AND APPARATUS FOR MULTI-STAGE FIRE SUPPRESSION

(75) Inventors: William A. Eckholm, Scottsdale, AZ (US); Matthew Sampson, Phoenix, AZ (US); Ryan Gamboa, Chandler, AZ (US)

(73) Assignee: Firetrace USA, LLC, Scottsdale, AZ (US)

( * ) Notice: Subject to any disclaimer, the term of this patent is extended or adjusted under 35 U.S.C. 154(b) by 624 days.

This patent is subject to a terminal disclaimer.

(21) Appl. No.: 13/023,701

(22) Filed: Feb. 9, 2011

(65) Prior Publication Data

US 2012/0199370 A1 Aug. 9, 2012

(51) Int. Cl.
*A62C 2/00* (2006.01)
*A62C 3/00* (2006.01)
*A62C 37/38* (2006.01)

(52) U.S. Cl.
CPC ..... *A62C 37/38* (2013.01)
USPC ..... 169/46; 169/7; 169/16; 169/60; 169/62

(58) Field of Classification Search
USPC ..... 169/46, 58, 60, 62, 7, 16
See application file for complete search history.

(56) References Cited

U.S. PATENT DOCUMENTS

| | | | | |
|---|---|---|---|---|
| 5,211,246 | A * | 5/1993 | Miller et al. | 169/62 |
| 5,242,023 | A | 9/1993 | Terry et al. | |
| 5,351,760 | A * | 10/1994 | Tabor, Jr. | 169/65 |
| 6,676,081 | B2 * | 1/2004 | Grabow et al. | 244/129.2 |
| 7,456,750 | B2 | 11/2008 | Popp et al. | |
| 7,712,542 | B2 | 5/2010 | Munroe | |
| 7,810,577 | B2 | 10/2010 | Popp et al. | |
| 7,878,258 | B2 * | 2/2011 | Lindstrom et al. | 169/61 |
| 8,459,369 | B2 * | 6/2013 | Eckholm et al. | 169/20 |
| 2008/0017393 | A1 * | 1/2008 | Whitney | 169/60 |
| 2009/0084561 | A1 | 4/2009 | Popp et al. | |
| 2009/0178813 | A1 * | 7/2009 | Eckholm et al. | 169/20 |
| 2011/0011600 | A1 | 1/2011 | Eckholm et al. | |

FOREIGN PATENT DOCUMENTS

WO 2007111897 A1 10/2007

* cited by examiner

*Primary Examiner* — Dinh Q Nguyen
(74) *Attorney, Agent, or Firm* — The Noblitt Group, PLLC

(57) ABSTRACT

A multi-stage fire suppression system according to various aspects of the present invention is configured to deliver a fire suppressant material in response to multiple detections of a fire condition over time. In one embodiment, the multi-stage fire suppression system comprises at least two pressure tubes each having a different internal pressure. Each pressure tube is adapted to generate a pneumatic signal in response to exposure to a different trigger event. The pneumatic signal is used to activate a suppression system and release the fire suppressant material from a container. The multi-stage fire suppression system may also be configured to signal a secondary hazard detection system that a fire has been detected.

12 Claims, 5 Drawing Sheets

METHODS AND APPARATUS FOR MULTI-STAGE FIRE SUPPRESSION

BACKGROUND OF THE INVENTION

Fire suppression systems often comprise a detecting element, an electronic control board, and an extinguishing system. When the detecting element detects a condition associated with a fire, it sends a signal to the control board. The control board then typically sounds an alarm and triggers the extinguishing system in the area monitored by the detecting element. Such systems, however, are complex and require significant installation time and cost. In addition, such systems may be susceptible to failure in the event of malfunction or loss of power.

SUMMARY OF THE INVENTION

A multi-stage fire suppression system according to various aspects of the present invention is configured to deliver a fire suppressant material in response to multiple detections of a fire condition over time. In one embodiment, the multi-stage fire suppression system comprises at least two pressure tubes each having a different internal pressure. Each pressure tube is adapted to generate a pneumatic signal in response to exposure to a different trigger event. The pneumatic signal is used to activate a suppression system and release the fire suppressant material from a container. The multi-stage fire suppression system may also be configured to signal a secondary hazard detection system that a fire has been detected.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various vessels, sensors, detectors, control materials, valves, and the like, which may carry out a variety of functions. In addition, the present invention may be practiced in conjunction with any number of hazards, and the system described is merely one exemplary application for the invention. Further, the present invention may employ any number of conventional techniques for delivering control materials, sensing hazard conditions, controlling valves, and the like.

Methods and apparatus for multi-stage fire suppression according to various aspects of the present invention may operate in conjunction with any suitable mobile and/or stationary application. Various representative implementations of the present invention may be applied to any system for suppressing fires. Certain representative implementations may include, for example, portable and/or non-portable containers, unit load devices, cargo containers, intermodal containers, and storage units.

Figure 1:
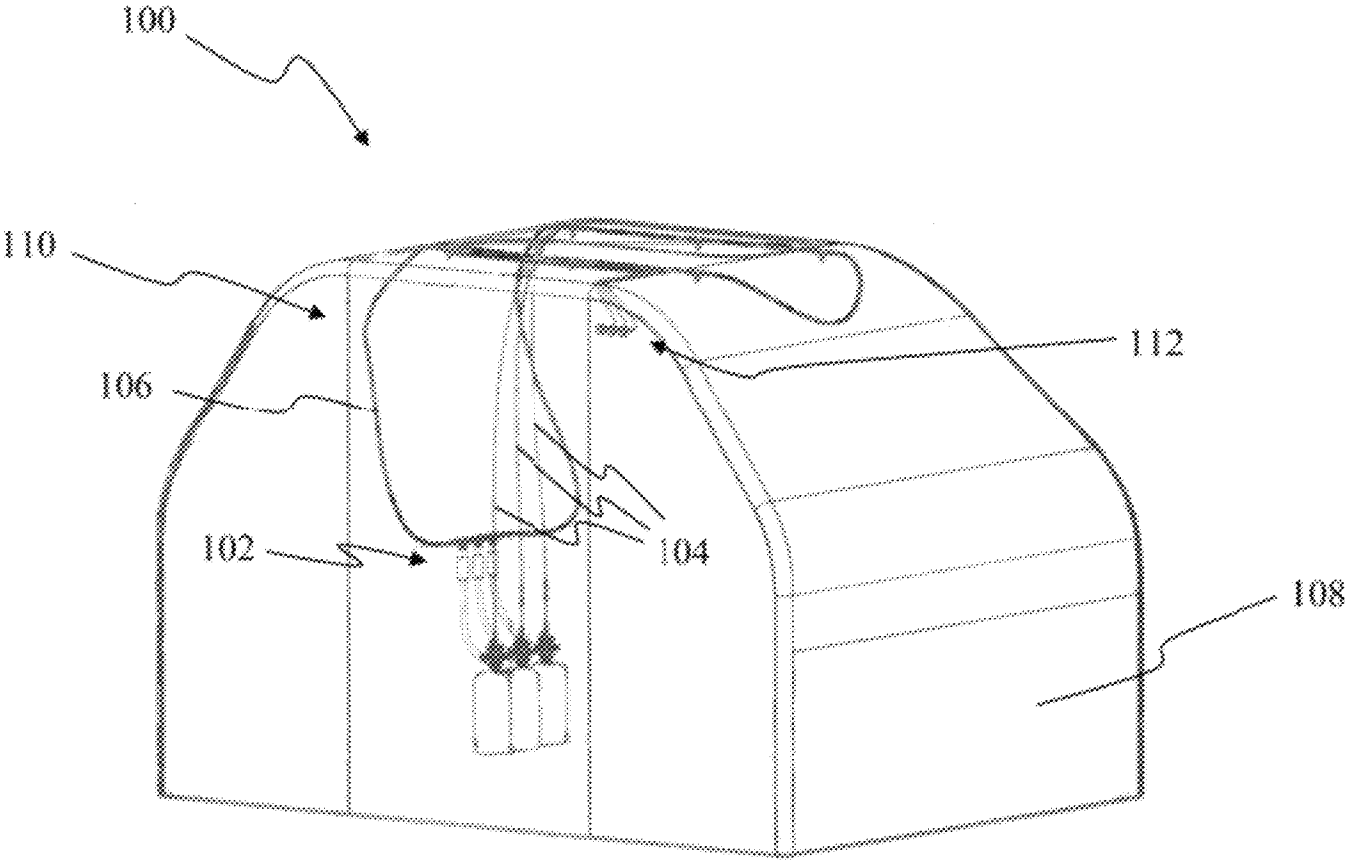
FIG. 1 is representatively illustrates a multi-stage fire suppression system according to various aspects of the present invention.

Referring now to FIG. 1, a multi-stage fire suppression system 100 for suppressing a fire according to various aspects of the present invention may comprise a suppression system 102 for providing a control material, such as a fire suppressant, to an interior location of a container 108, such as a unit load device for aircraft or an intermodal container for a cargo ship. The hazard control system 100 may further comprise a detection system 104 for detecting one or more hazards, such as smoke, open flames, or heat. The suppression system 102 and the detection system 104 may also be suitably configured to be coupled together within the container 108. The container 108 may define any type of area or enclosed volume 110 that may experience a hazard, such as a fire to be controlled by the multi-stage fire suppression system 100. For example, the enclosed volume 110 may comprise the interior of a cabinet, a vehicle, a storage facility, and/or other like area.

The suppression system 102 is suitably adapted to respond to the detection of a hazard or fire condition by releasing an appropriate control material to mitigate the detected condition. The suppression system 102 may comprise any suitable device or components for affecting a hazard or suppressing a fire. For example, referring now to FIGS. 1 and 2, in one embodiment the suppression system 102 may comprise at least one vessel 208 that is coupled to a deployment valve 210, wherein the vessel 208 is suitably configured to house a control material. Each vessel 208 and deployment valve 210 combination may be further coupled to a delivery system 106 and the detection system 104.

The vessel 208 may comprise any appropriate source of control material, such as a pressure vessel for containing a control material under pressure. The vessel 208 may comprise any suitable system for storing and/or providing the control material, such as a tank, pressurized bottle, reservoir, or other container. The vessel 208 may be suitably configured to contain a mass or volume of any suitable control material such as a liquid, gas, or solid material. The vessel 208 may also be configured to withstand various operating conditions including temperature variations of up to 300 degrees Fahrenheit, vibration, impact, and environmental pressure changes. The vessel 208 may comprise various materials, shapes, dimensions, and coatings according to any appropriate criteria, such as corrosion, cost, deformation, fracture, and/or the like.

The vessel 208 may also be suitably configured to contain the control material under pressure. For example, in one embodiment, the vessel 208 may hold the control material at a pressure of up to about 360 pounds per square inch (psi). In a second embodiment, the vessel 208 may be configured to house the second hazard control material at a pressure of up to about 800-850 psi.

The vessel 208 and the control material may be adapted according the particular hazard and/or environment. For example, if the multi-stage fire suppression system 100 is configured to control an enclosed volume 110 such that the enclosed volume 110 maintains a low oxygen level, the vessel 208 may be configured to provide a control material which absorbs or dilutes oxygen levels when transmitted into the enclosed volume 110. As another example, if the multi-stage fire suppression system 100 is configured to protect materials within the container 108 from open flames associated with an active fire, the vessel 208 may be configured withstand temperatures associated with a fire while providing a fire suppressant which suppresses a fire when dispersed into the container 108.

The multi-stage fire suppression system 100 may comprise one or more control materials such as fire suppressants, neutralizing agents, or gasses. The control material may also he adapted to neutralize or combat one or more hazards, such as a fire suppressant or acid neutralizer. For example, one hazard control material may comprise a fire suppressant suitably adapted for transient events such as explosions or other rapid combustion. Alternatively, the control material may comprise a fire suppressant suitably adapted to suppress latent fires or other less rapidly developing fires. In one embodiment, a control material may comprise a common dry chemical suppressant such as ABC, BC, or D dry powder extinguishants. In another embodiment, the control material may comprise a fire suppressant mixture such as potassium acetate and water. In yet another embodiment, the control material may comprise a suppressant material further comprising additional chemicals or compounds such as various forms or combinations of lithium, sodium, potassium, chloride, graphite, acetylene, oxides, and magnetite.

The control material may also be adapted to have more than a single method of controlling the hazard. For example, the hazard control material may comprise multiple elements or compounds, wherein each compound has a different property such as being reactive or unreactive to heat, acting to deprive a fire of oxygen, absorbing heat radiated from the fire, and/or transferring heat from the fire to another compound.

The deployment valve 210 provides a seal to the vessel 208 allowing the control material to be held under pressure and may be selectively actuated to allow the control material to be released. The deployment valve 210 may also control the release of, or rate of release of, the control material. The deployment valve 210 may comprise any suitable system for maintaining the pressurized volume of the control material and for releasing that volume upon demand. For example, the deployment valve 210 may comprise a seal between the control material and the delivery system 106. The deployment valve 210 may be responsive to a detection signal from the detection system 104 and may be suitably adapted to break, open, or otherwise remove the pressure seal in response to the signal. Once the seal has been broken the entire volume of the control material may be released to the delivery system 106.

In another embodiment, the deployment valve 210 may be suitably configured to control the rate of release of the control material. For example, the deployment valve 210 may comprise a selectively activated opening such as a ball or gate valve that is configured to release a predetermined mass flow rate of fire suppressant material. The rate of release may be dependent on a given application or location and may be related to the pressure within the vessel 208 relative to the ambient pressure of the surrounding environment in the container 108.

The deployment valve 210 may also be configured to release the control material over a specific period of time. For example, the deployment valve 210 may be sized such that a total release of the control material occurs over a period ranging from about twenty to sixty seconds. Alternatively, the deployment valve 210 may be suitably adapted to release the control material over a relatively short period of time such as 0.1 seconds. The deployment valve 210 may also be configured to sustain a constant level of dispersed control material in a given volume.

The delivery system 106 is configured to deliver the control material to the enclosed volume 110 after it is released from the vessel 208. The delivery system 106 may comprise any suitable system for delivering a control material such as a pneumatic tube, a pipe, a duct, a perforated hose, or a sprayer. For example, in one embodiment, the delivery system 106 may comprise a conduit path from the vessel 208 to the location where the control material is required.

The delivery system 106 may comprise any suitable material such as metal, plastic, or polymer and may be suitably adapted to withstand elevated temperatures associated with fires or exposure to caustic chemicals. The delivery system 106 may also comprise a material that is specifically adapted to not withstand elevated temperatures.

Figure 2:
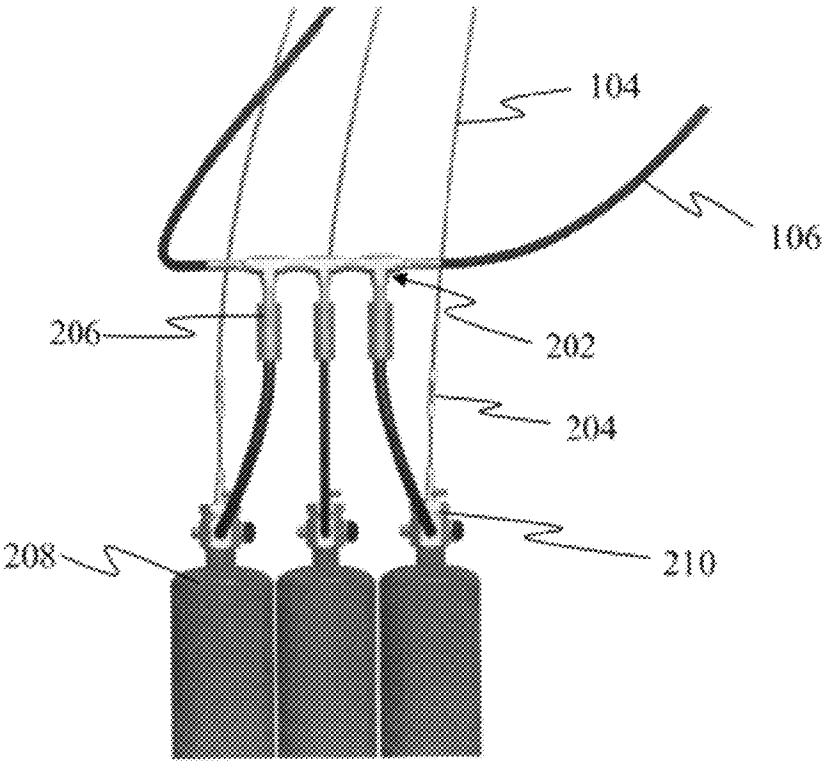
FIG. 2 representatively illustrates a detection system and suppression system interface.
Figure 3:
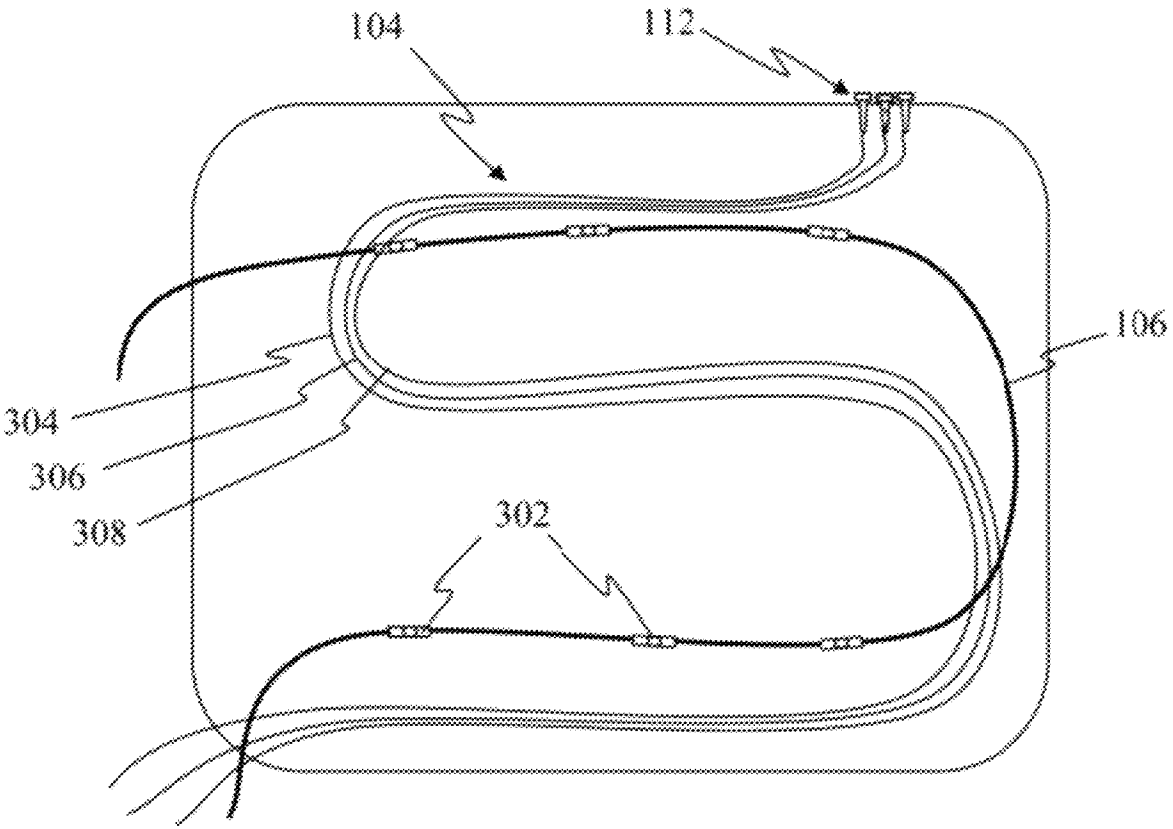
FIG. 3 representatively illustrates a top view installation of multiple detection elements and a delivery system in accordance with an exemplary embodiment of the present invention.

Referring now to FIGS. 2 and 3, in one embodiment, the delivery system 106 may comprise a hose having at least one nozzle 302, wherein the hose is coupled to the deployment valve 210 and routed throughout at least a portion of the enclosed volume 110 such that control material exiting the nozzle 302 is dispersed into the enclosed volume 110. For example, if a fire is detected in the enclosed volume 110, a fire suppressant agent may be transmitted from the vessel 208 through the hose to the nozzle 302 and the into the enclosed volume 110 to suppress and/or extinguish the fire.

In another embodiment, the delivery system 106 may also be configured to act as the detection system 104. The delivery system 106 may also be pressurized or be configured to withstand pressures of up to 800 psi. For example, in one embodiment, the delivery system 106 may comprise a plastic pressurized tube, wherein the plastic is adapted to rupture or otherwise break in response to an applied heat load such as a fire. For example, rupturing of the delivery system 106 may trigger the deployment valve 210 to release the control material. The released control material is then routed through the delivery system 106 to the location of the rupture where it exits and is dispersed into the container 108.

The suppression system 102 may also comprise a manifold 202 configured to couple multiple vessels 208 to the delivery system 106. The manifold may comprise any suitable system for combining multiple single discharge units into a single dispersal system. The manifold 202 may also be suitably adapted to be modular and comprise connection components that allow for total system capacity to be expanded or reduced as needed according to a given application. The manifold 202 may also be suitably configured to prevent the contents of a first vessel 208 from entering into a second vessel 208. For example, the manifold may comprise at least one one-way valve 206 that is suitably configured to only allow the control material to flow in a single direction.

The detection system 104 generates a detection signal in response to a detected hazard. The detection system 104 may comprise any appropriate system for detecting one or more specific hazards and generating a corresponding detection signal, such as a system for detecting smoke, heat, open flames, poison, radiation, and the like. In the present embodiment, the detection system 104 may be disposed within the enclosed volume 110 of the container 108 and be adapted to detect a condition, such as a fire, and generate an appropriate detection signal that will activate the suppression system 102. The detection signal may comprise any appropriate signal for transmitting relevant information, such as an electrical pulse or signal, acoustic signal, mechanical signal, wireless signal, pneumatic signal, and the like. In the present embodiment, the detection signal comprises a pneumatic signal generated in response to detection of the hazard condition.

The detection system 104 may comprise any suitable system for detecting hazards. For example, the detection system may comprise a pressure tube suitably configured to be held under a predetermined pressure until exposed to trigger event such as exposure to flame or ambient temperatures associated with a fire. Degradation of the pressure tube after being pressurized causes the pressure tube to leak, burst, or otherwise result in a loss of internal pressure. Referring again to FIG. 1, in one embodiment, the detection system 104 may comprise multiple pressure tubes routed substantially adjacent to at least a portion of a top interior surface of the enclosed volume 110. The detection system 104 may further comprise a smoke detector configured to release the pressure in the pressure tube upon detecting smoke within the container 108. For example, the smoke detector may be suitably adapted to activate a valve connected to the pressure tube to cause the internal pressure of the pressure tube to change.

The loss of internal pressure may also create the pneumatic signal that is used to activate the suppression system 102. In the present embodiment, the detection system 104 generates the pneumatic signal by changing pressure in the pressure tube, such as by releasing the pressure in the pressure tube. The pressure tube may be pressurized with a higher or lower internal pressure than an ambient pressure in the enclosed volume 110 of the container 108. Equalizing the internal pressure with the ambient pressure generates the pneumatic detection signal. The internal pressure may be achieved and sustained in any suitable manner, for example by pressurizing and sealing the pressure tube, connecting the tube to an independent pressure source such as a compressor or pressure bottle, or connecting the pressure tube to a pressure vessel having a pressurized fluid and/or gas. Any fluid that may be configured to transmit a change in pressure within the pressure tube may be used. For example, a substantially incompressible fluid such as a water-based fluid may be sensitive to changes in temperature and/or changes in the internal volume of the pressure tube sufficient to signal coupled devices in response to a change in pressure. As another example, a substantially inert fluid such as air, nitrogen, or argon may be sensitive to changes in temperature and/or changes in the internal volume of the pressure tube sufficient to signal coupled devices in response to a change in pressure.

The pressure tube may also be configured to be sealed on each end while maintaining a predetermined internal pressure. The pressure tube may be sealed by any suitable method. For example, referring again to FIGS. 1 and 2, one end of the pressure tube may be coupled to the deployment valve 210 and the other end may sealed at a termination point 112 at a wall of the container 108. The termination point 112 may comprise any suitable method or device for sealing the pressure tube, such as a plug, a pressure gauge, a schrader valve, or a presta valve. The termination point 112 may also provide a location where the pressure tube may be pressurized.

The pressure tube may be comprised of any suitable material such that its structural integrity may be degraded when subjected to open flames, elevated temperatures associated with a fire, or a particular energy level associated with a fire. For example, the pressure tube may comprise any appropriate materials, including Firetrace™ detection tubing, aluminum, aluminum alloy, cement, ceramic, copper, copper alloy, composites, iron, iron alloy, nickel, nickel alloy, organic materials, polymer, titanium, titanium alloy, rubber, and/or the like. The pressure tube may be configured according to any appropriate shapes, dimensions, materials, and coatings according to desired design considerations such as corrosion, cost, deformation, fracture, combinations, and/or the like.

Referring again to FIG. 1, in one embodiment, the detection system 104 may comprise three different pressure tubes each held at a different internal pressure. The internal pressure of each tube may be determined by any suitable factor. In one embodiment, the internal pressure of a pressure tube may be determined by the temperature or energy level at which degradation of the tube occurs. The pressure tube may be comprised of a material that degrades differently when subjected to various combinations of ambient temperature and internal pressure. For example, the pressure tube may demonstrate an inverse relationship between the internal pressure of the pressure tube and the temperature that causes the pressure tube to degrade, leak, and/or burst at. In an alternative embodiment, each pressure tube may be comprised of a different material that is suitably adapted to degrade when subjected to temperatures. Referring now to FIG. 3, in one embodiment, a first pressure tube 304 may be held at a first pressure, a second pressure tube 306 held at a second pressure which is higher than the first pressure, and a third pressure tube 308 held at a pressure which is higher than the second pressure, wherein each pressure corresponds to a particular ambient or surrounding temperature threshold that will cause the pressure tube to degrade, leak, and/or burst.

Each pressure tube may also comprise any suitable element or device to maintain the integrity of the suppression system 102. For example, in one embodiment, one pressure tube may be pressurized to a level substantially equivalent to the pressure of the vessels 208. Each additional pressure tube may be pressurized to levels higher than that of any of the vessels 208 in the suppression system 102 creating a pressure differential at the deployment valve 210 which may range between 50-600 psi. To reduce the potential for pressure leakage from the pressure tube through the deployment valve 210 and into a connected vessel 208, each pressure tube pressurized higher than the pressure of the connected vessel 208 may be configured with a one-way valve 204 which is suitably adapted to prevent higher pressures from bleeding into a lower pressure system.

Figure 5:
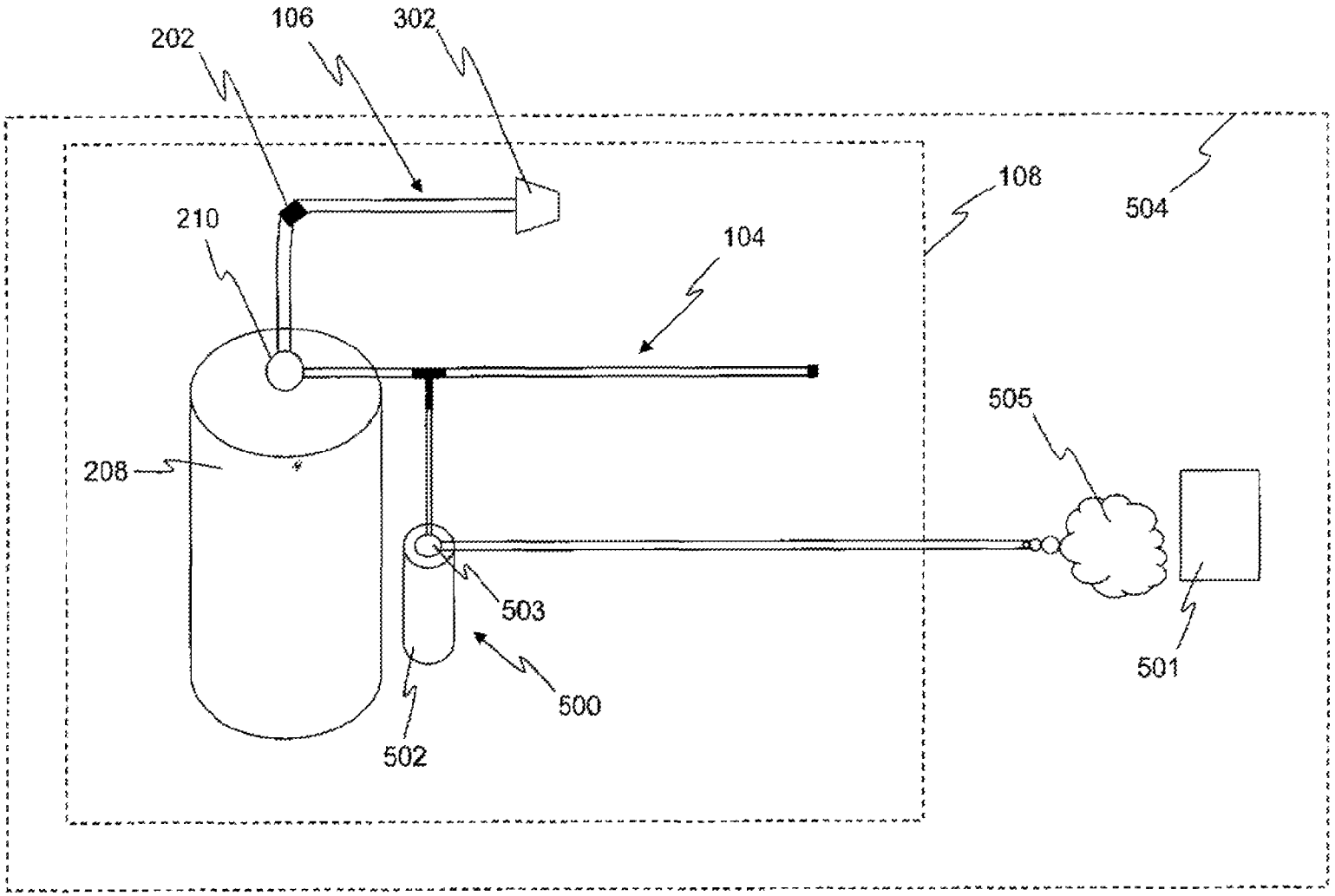
FIG. 5 representatively illustrates the multi-stage fire suppression system coupled to a signaling system in accordance with an embodiment of the present invention.

Referring now to FIG. 5, the multi-stage fire suppression system 100 may be further configured to operate autonomously or in conjunction with external systems, for example a fire detection system 501 for a building, an aircraft, marine vehicle, cargo holding area, or the like in which the container 108 be disposed within. For example, the multi-stage fire suppression system 100 and the container 108 may both be disposed within a larger enclosed area such as a cargo holding bay 504 of a transport aircraft having a fire system detection system that comprises a system designed to detect and/or suppress a fire condition within the holding bay area 504. The operation with the external systems may be configured in any suitable manner, for example to initiate an alarm, control the operation of the fire detection system 501, automatically notify emergency services, and/or the like.

The multi-stage fire suppression system 100 may further comprise a triggering system 500 configured to be responsive to the pneumatic signal generated by the detection system 104 following a loss of pressure in a pressure tube. The triggering system 500 may be adapted in any suitable manner to activate, signal, notify, or otherwise communicate with the fire detection system 501, such as remotely, electrically, and/or mechanically. The triggering system 500 may also be adapted to provide a signal suitable to the method of operation of the fire detection system control unit 501. For example, in one embodiment the triggering system 500 may comprise a trigger valve 503 coupled between a pressure vessel 502 containing a signal material 505 and the detection system 104. The trigger valve 503 may be configured to activate in response to a change in pressure on the detection system 104 side of the valve causing the signal material 505 to be released. The fire detection system 501 may sense the release of the signal material 505 and respond accordingly, such as by activating an audible alarm, sending a signal to a monitored control panel, communicating with emergency services, or activating a secondary fire suppressant system.

The signal material 505 may comprise any suitable substance, such as an inert gas, aerosol, colored particles, smoke, and/or a fire suppressant agent. For example, in one embodiment, the signal material 505 may comprise compressed nitrogen contained within the pressure vessel 502 under a pre-determined pressure such that it forms a dissipating cloud upon release. In another embodiment, the signal material 505 may comprise a powdered form of heavier than air particulate matter that forms a cloud upon release but subsequently falls out of suspension in the air.

In another embodiment, the triggering system 500 may comprise a communication interface connected to a remote control unit to signal the fire detection system 501 in response to a detected fire condition. For example, the triggering system 500 may be suitably adapted to generate a radio frequency signal in response to the pneumatic signal to communicate to the fire detection system 501 that a fire has been detected. The multi-stage fire suppression system 100 may also be configured to respond to signals from the fire detection system 501, for example to provide status indicators for the multi-stage fire suppression system 100 and/or remotely activate the multi-stage fire suppression system 100.

In other embodiments, the multi-stage fire suppression system 100 may be configured with multiple vessels 208, pressure tubes, nozzles 302, pressure control valves, hazard detectors, and/or supplementary pressure switches. For example, the multi-stage fire suppression system 100 may be configured to include multiple vessels 208 coupled to a single nozzle 108 and hazard detector, such as if controlling a particular hazard requires drawing multiple types of control material which cannot be stored together, or if suppressing the anticipated hazards requires different control materials to be applied at different times. As another example, the multi-stage fire suppression system 100 may be configured to include more than one pressure tube coupled to a single nozzle 302 and hazard detector, for example to provide multiple paths for delivering the control material, or to draw different control materials in response to different conditions. Given the multiplicity of combinations of elements, these examples are illustrative rather than exhaustive.

Figure 4:
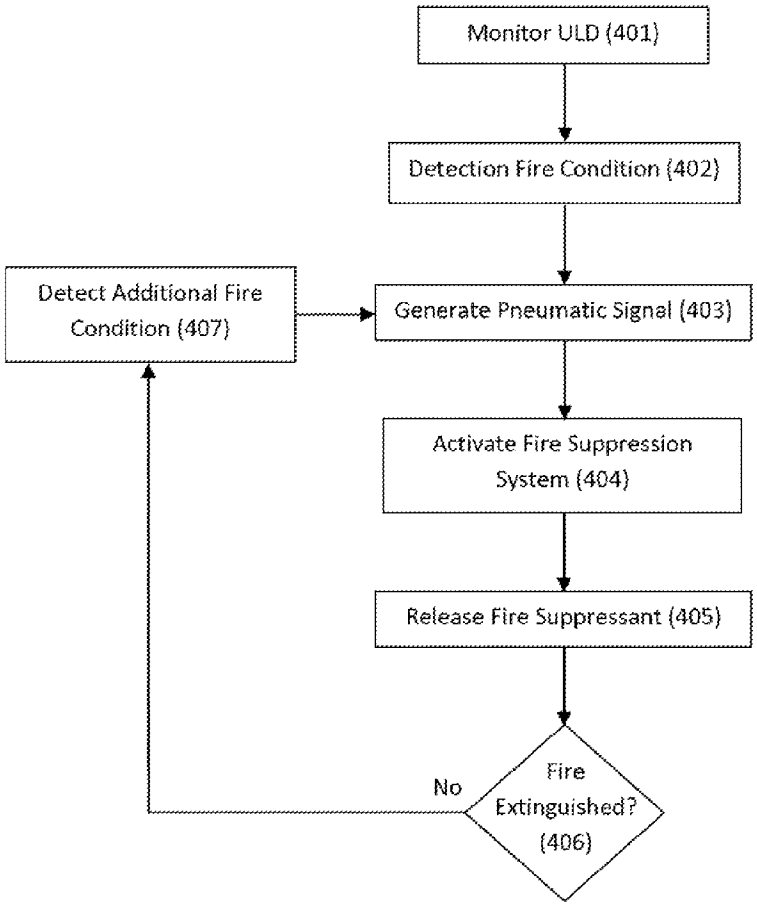
FIG. 4 is a flow chart of an exemplary embodiment of the present invention.

Referring to FIGS. 3 and 4, in operation, the multi-stage fire suppression system 100 is initially configured such that the detection system 104 monitors a given area for the existence of a fire condition (401). For example, in the event of a fire condition inside the container 108, the ambient temperature inside the container 108 will increase at a rate determined by the intensity of the fire. Once the temperature reaches a predetermined threshold value, the third pressure tube 308 may burst (402) creating a detection signal (403) that is sent to the suppression system 102 (404) causing a fire suppressant to be released into the enclosed volume 110 of the container 108 (405). If the fire suppressant doesn't completely extinguish the fire, the fire may smolder and eventually regain intensity causing the internal temperature of the container 108 to increase again. Then, if the increasing temperature reaches a second threshold value which may be slightly higher than the predetermined threshold value the second pressure tube 306 may burst creating a second detection signal (407) that is sent to the suppression system 102 causing it to release additional suppressant material into the container 108. If the fire still isn't extinguished, the suppression system may release additional suppressant if the temperature rises to a level causing the first pressure tube 308 to lose pressure.

In the event of a high energy fire, the rise in temperature or the amount of energy that the pressure tubes are exposed to may be such that at least two pressure tubes lose pressure substantially simultaneously. This may cause the suppression system 102 to immediately release an equivalent amount of fire suppressant that would have been released had the pressure tubes lost pressure in a sequential order over a period of time.

These and other embodiments for methods of controlling a hazard may incorporate concepts, embodiments, and configurations as described with respect to embodiments of apparatus for controlling a hazard as described above. The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The invention has been described with reference to specific exemplary embodiments. Various modifications and changes, however, may be made without departing from the scope of the present invention. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to a preferred embodiment. However, changes and modifications may be made to the preferred embodiment without departing from the scope of the present invention. These and other changes or modifications are intended to be included within the scope of the present invention, as expressed in the following claims.

The invention claimed is:

1. A multi-stage fire detection and suppression system for a container, comprising:

a detection system configured to attach to an interior portion of the container, wherein the detection system is adapted to:

detect at least two sequential trigger events; and generate a detection signal in response to each detected trigger event, wherein:

a first detection signal corresponds to a first detected fire; and a second detection signal corresponds to a second detected fire resulting from an incomplete suppression of the first detected fire; and a suppression system coupled to the detection system and disposed within the container, wherein the suppression system is adapted to:

release a fire suppressant into the container in response to the first detection signal; and release additional fire suppressant into the container in response to the second detection signal.

2. A multi-stage fire detection and suppression system according to claim 1, wherein:

a first trigger event comprises an ambient temperature within the container reaching a first predetermined threshold value; and each subsequent sequential trigger event comprises the ambient temperature within the container reaching a threshold value that exceeds the immediately preceding threshold value.

3. A multi-stage fire detection and suppression system according to claim 1, wherein the detection system comprises:

a first detection element adapted to generate the first detection signal in response to a first triggering event; and a second detection element adapted to generate the second detection signal in response to a second triggering event.

4. A multi-stage fire detection and suppression system according to claim 3, wherein:

the first detection element comprises a first pressure tube adapted to have a first internal pressure, wherein at least a portion of the first pressure tube is configured to leak in response to exposure to the first triggering event and generate the first detection signal; and the second detection element comprises a second pressure tube adapted to have a second internal pressure less than the first internal pressure, wherein at least a portion of the second pressure tube is configured to leak in response to exposure to the second triggering event and generate the second detection signal.

5. A multi-stage fire detection and suppression system according to claim 3, wherein the suppression system comprises:

a first pressure vessel configured to couple to the first detection element, wherein the first pressure vessel is adapted to:

contain a first fire suppressant material under pressure; and discharge the first fire suppressant material in response to the first detection signal;

a second pressure vessel configured to couple to the second detection element, wherein the second pressure vessel is adapted to:

contain a second fire suppressant material under pressure; and discharge the second fire suppressant material in response to the second detection signal; and a delivery system configured to couple to the first and second pressure vessels, wherein the delivery system is adapted to disperse the first and second fire suppressants to the interior of the container.

6. A multi-stage fire detection and suppression system according to claim 5, wherein the suppression system further comprises:

a first deployment valve configured to couple between the first pressure vessel and the first detection element, wherein the first deployment valve is adapted to activate in response to the first detection signal;

a second deployment valve configured to couple between the second pressure vessel and the second detection element, wherein the second deployment valve is adapted to activate in response to the second detection signal; and a manifold configured to couple the first and second deployment valves to the delivery system, wherein the manifold is adapted to:

prevent the first fire suppressant material from entering the second pressure vessel; and prevent the second fire suppressant material from entering the first pressure vessel.

7. A multi-stage fire detection and suppression system according to claim 1, further comprising a triggering system disposed adjacent to the discharge system and coupled to the detection system, wherein:

the triggering system is configured to generate a trigger signal in response to the first detection signal; and the trigger signal is transmitted to a secondary fire detection system.

8. A method of detecting and suppressing a fire within an enclosed container, comprising:

disposing a detection system adjacent to an inner surface of the container;

coupling a suppression system to the detection system, wherein the suppression system comprises a fire suppressant and is responsive to the detection system;

detecting at least two sequential trigger events associated with the fire, wherein:

a first trigger event comprises a temperature within the container exceeding a predetermined threshold value that corresponds to a fire; and each subsequent sequential trigger event comprises the temperature within the container reaching a threshold value that exceeds the immediately preceding threshold value and corresponds to an incomplete suppression of the fire;

generating a detection signal in response to each detected of trigger event;

dispersing the fire suppressant into the container in response to a first generated detection signal; and dispersing additional fire suppressant into the container in response to each additional generated detection signal.

9. A method of detecting and suppressing a fire according to claim 8, wherein disposing the detection system adjacent to an inner surface of the container comprises routing at least one detection element adapted to generate the detection signal in response to the trigger event proximate to the inner surface of the container.

10. A method of detecting and suppressing a fire according to claim 9, wherein:

a first detection element comprises a first pressure tube adapted to have a first internal pressure, wherein at least a portion of the first pressure tube is configured to leak in response to exposure to the predetermined threshold value and generate the first detection signal; and a second detection element comprises a second pressure tube adapted to have a second internal pressure lower than the first internal pressure, wherein at least a portion of the second pressure tube is configured to leak in response to exposure to a second threshold value and generate the second detection signal.

11. A method of detecting and suppressing a fire according to claim 10, wherein the suppression system comprises:

a first pressure vessel configured to couple to the first detection element, wherein the first pressure vessel is adapted to:

contain a first fire suppressant material under pressure; and discharge the first fire suppressant material in response to the first detection signal;

a second pressure vessel configured to couple to the second detection element, wherein the second pressure vessel is adapted to:

contain a second fire suppressant material under pressure; and discharge the second fire suppressant material in response to the second detection signal; and a delivery system configured to couple to the first and second pressure vessels, wherein the delivery system is adapted to disperse the first and second fire suppressants to the interior of the container.

12. A method of detecting and suppressing a fire according to claim 11, wherein the suppression system further comprises:

a first deployment valve configured to couple between the first pressure vessel and the first detection element, wherein the first deployment valve is adapted to activate in response to the first detection signal;

a second deployment valve configured to couple between the second pressure vessel and the second detection element, wherein the second deployment valve is adapted to activate in response to the second detection signal; and a manifold configured to couple the first and second deployment valves to the delivery system, wherein the manifold is adapted to:

prevent the first fire suppressant material from entering the second pressure vessel; and prevent the second fire suppressant material from entering the first pressure vessel.

* * * * *